US011591553B2

(12) United States Patent
Meier et al.

(10) Patent No.: US 11,591,553 B2
(45) Date of Patent: Feb. 28, 2023

(54) METHOD FOR PRODUCING A WASHING AGENT PORTION UNIT WITH IMPROVED OPTICAL AND RHEOLOGICAL PROPERTIES

(71) Applicant: Henkel AG & Co. KGaA, Duesseldorf (DE)

(72) Inventors: Frank Meier, Duesseldorf (DE); Peter Schmiedel, Duesseldorf (DE); Daniel Thomas Piorkowski, Fairfield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/936,956

(22) Filed: Jul. 23, 2020

(65) Prior Publication Data

US 2022/0025304 A1 Jan. 27, 2022

(51) Int. Cl.

| | |
|---|---|
| ***C11D 11/00*** | (2006.01) |
| ***C11D 17/04*** | (2006.01) |
| ***C11D 1/72*** | (2006.01) |
| ***C11D 1/83*** | (2006.01) |
| ***C11D 3/04*** | (2006.01) |
| ***C11D 3/20*** | (2006.01) |
| ***C11D 3/43*** | (2006.01) |

(52) U.S. Cl.

CPC ..... *C11D 17/043* (2013.01); *C11D 1/83* (2013.01); *C11D 3/046* (2013.01); *C11D 3/2075* (2013.01); *C11D 3/43* (2013.01); *C11D 11/0017* (2013.01); *C11D 1/72* (2013.01)

(58) Field of Classification Search

None

See application file for complete search history.

(56) References Cited

U.S. PATENT DOCUMENTS

| | | | | |
|---|---|---|---|---|
| 3,658,552 | A | 4/1972 | Carlson et al. | |
| 6,455,487 | B1 * | 9/2002 | Mertens | C11D 3/046 510/491 |
| 6,855,680 | B2 | 2/2005 | Smerznak et al. | |
| 8,901,062 | B2 | 12/2014 | De Meirleir et al. | |
| 9,023,786 | B2 | 5/2015 | Schmiedel et al. | |
| 9,187,714 | B2 | 11/2015 | Schmiedel et al. | |
| 10,392,588 | B2 | 8/2019 | Renilde et al. | |
| 2002/0045559 | A1 | 4/2002 | Forth et al. | |
| 2002/0169092 | A1 * | 11/2002 | Alexandre Catlin | B65B 47/10 510/220 |
| 2002/0169095 | A1 * | 11/2002 | Forth | C11D 3/361 510/480 |
| 2004/0144064 | A1 * | 7/2004 | Viltro | C11D 17/042 53/453 |
| 2007/0004612 | A1 | 1/2007 | Catlin et al. | |
| 2014/0243253 | A1 * | 8/2014 | Schmiedel | C11D 1/831 510/427 |
| 2015/0074921 | A1 * | 3/2015 | Miracle | C09B 69/00 8/137 |
| 2015/0275154 | A1 | 10/2015 | Souter et al. | |
| 2015/0376550 | A1 * | 12/2015 | Ohtani | C11D 17/042 510/296 |
| 2015/0376556 | A1 * | 12/2015 | Ohtani | C11D 3/43 510/386 |
| 2017/0015948 | A1 * | 1/2017 | Johnson | C11D 3/30 |
| 2018/0037858 | A1 * | 2/2018 | Keuleers | B65D 65/46 |
| 2018/0265816 | A1 * | 9/2018 | Lintula | C11D 3/30 |
| 2019/0225743 | A1 * | 7/2019 | Bekaert | C08G 63/6886 |
| 2021/0079320 | A1 * | 3/2021 | Smets | C11D 3/3788 |
| 2021/0155883 | A1 * | 5/2021 | Piorkowski | C11D 1/29 |

FOREIGN PATENT DOCUMENTS

EP 3517596 A1 7/2019

OTHER PUBLICATIONS

"Microplastic-Free, Opacified Liquid Laundry Detergents" U.S. Appl. No. 62/938,707 Piorkowski, Daniel Thomas et al. filed Nov. 21, 2019.

International Searching Authority, PCT International Search Report, PCT/EP2021/067520, dated Oct. 13, 2021, pp. 1-16, European Patent Office, Rijswijk, NL.

* cited by examiner

*Primary Examiner* — Lorna M Douyon

(74) *Attorney, Agent, or Firm* — Bojuan Deng

(57) ABSTRACT

A method for producing a washing agent portion unit having at least one receiving chamber surrounded by a water-soluble film, including the steps of: a) transporting a first water-soluble film in the direction of a dosing station; b) molding the first water-soluble film into the cavities of a deep-drawing die located below the water-soluble film, forming at least one cavity in the direction of travel of the film; c) filling the cavity by way of the dosing station with a first flowable washing agent preparation containing, based on its total weight, i) 20 to 80 wt. % surfactant; ii) 2 to 15 wt. % fatty acid; iii) 0.3 to 8 wt. % of the salt of a divalent cation; iv) 8 to 35 wt. % solvent; d) transporting the filled cavity in the direction of a sealing station; e) sealing the filled cavity with a second water-soluble film, and the washing agent portion.

17 Claims, No Drawings

METHOD FOR PRODUCING A WASHING AGENT PORTION UNIT WITH IMPROVED OPTICAL AND RHEOLOGICAL PROPERTIES

FIELD OF THE INVENTION

The present invention relates to a method for producing a washing agent portion unit having at least one receiving chamber surrounded by a water-soluble film material, which in turn is filled with a highly concentrated textile washing agent. The application further relates to the washing agent portion units that can be produced using this method.

BACKGROUND OF THE INVENTION

Continuously changing requirements are placed on the forms in which washing and cleaning agents are manufactured and sold. For some time, the consumer has paid special attention to the easy dosing of washing and cleaning agents and the simplification of the operational steps required to carry out a washing or cleaning process. A technical solution is provided by pre-portioned washing or cleaning agents, for example film pouches having one or more receiving chambers for solid or liquid washing or cleaning agents.

The film pouches described above are produced by multistage processes, in the course of which water-soluble film materials are molded into cavities, filled, and subsequently sealed, for example by means of negative pressure. The efficiency of filling the cavities and the subsequent sealing thereof is influenced, among other factors, by the chemical and physical properties of the textile washing agent to be packaged.

The physical properties of the filling material are of great importance for the efficiency of the filling process. In the case of solid filling materials, these properties are, for example, the particle size and particle size distribution or the dust content; in the case of liquid or flowable filling materials, the viscosity properties, primarily the absolute viscosity and viscosity fluctuations, but also the rheological properties, must be taken into account.

While the absolute level of viscosity influences the design of the method equipment, for example the power of the pumps used, or the filling time, viscosity fluctuations with constant running speeds of the packaging equipment can lead to fluctuations in the degree of filling of the cavities and thus to production waste. At high running speeds or changes in the rotating speeds of the packaging apparatus, for example when starting up such an apparatus, viscosity fluctuations lead to minor dosing errors of the filling material in the edge region of the cavity. These dosing errors subsequently affect the sealing of the cavity and thus also increase the production waste.

In addition, aging effects of the filling materials during the assembly process, for example short or varying pot lives, can significantly disrupt production or lead to system downtime.

The provision of flowable filling materials having an easily adjustable, sufficiently high viscosity and rheology which is sufficiently stable both in terms of formulation fluctuations and in terms of temperature fluctuations is therefore an essential prerequisite for the efficient packaging thereof.

The commercial success of a washing agent portion unit is of course also determined, in addition to processing-related aspects, by the ability to provide a product that meets consumer interests. An essential means of communicating product quality and product claims is the appearance of the product, including the shape and color of the portion unit. While colored, i.e. non-white, liquid washing agents can be obtained in a simple manner by adding appropriate dyes, the provision of white liquid washing agents is more challenging because the opacifying agents previously used for their production are increasingly being critically assessed from an ecological point of view. Against this background, the provision of an ecologically acceptable opacifying agent is a further development objective in the field of liquid washing and cleaning agents.

BRIEF SUMMARY OF THE INVENTION

In summary, the object of the application was to provide an efficient method for producing visually appealing, concentrated washing agent portion units.

A first subject matter of the present invention is a method for producing a washing agent portion unit having at least one filled receiving chamber surrounded by a water-soluble film, comprising the steps of:

a) transporting a first water-soluble film in the direction of a dosing station at a speed above 0.04 m/s, preferably above 0.08 m/s;
b) molding the first water-soluble film into the cavities of a deep-drawing die located below the water-soluble film, so as to form at least one cavity having a maximum diameter in the direction of travel of the film of between 3 and 75 mm;
c) filling the cavity by means of the dosing station with a first flowable washing agent preparation containing, based on its total weight,
   i) 20 to 80 wt. % surfactant;
   ii) 2 to 15 wt. % fatty acid;
   iii) 0.3 to 8 wt. % of the salt of a divalent cation;
   iv) 8 to 35 wt. % solvent;
d) further transporting the filled cavity in the direction of a sealing station at a speed of 0.04 m/s, preferably above 0.08 m/s;
e) sealing the filled cavity with a second water-soluble film.

The method according to the invention allows the efficient production of the washing agent portion units. The flowable washing agent preparations are characterized by a cloudy-white appearance and have a sufficiently high and stable viscosity for rapid dosing and rapid transport in the still-open filled cavities.

In the context of the method according to the invention, water-soluble films are formed in a deep-drawing apparatus and combined with flowable washing agent preparations to form washing agent portion units.

The water-soluble film in which the washing agent preparation is packaged can comprise one or more structurally different water-soluble polymer(s). Particularly suitable water-soluble polymer(s) include polymers from the group of (optionally acetalized) polyvinyl alcohols (PVAL) and the copolymers thereof.

Water-soluble films for producing the water-soluble wrapping are preferably based on a polyvinyl alcohol or a polyvinyl alcohol copolymer of which the molecular weight is in the range of from 10,000 to 1,000,000 $gmol^{-1}$, preferably from 20,000 to 500,000 $gmol^{-}$, particularly preferably from 30,000 to 100,000 $gmol^{-1}$, and in particular from 40,000 to 80,000 $gmol^{-1}$.

The production of polyvinyl alcohol and polyvinyl alcohol copolymers generally includes the hydrolysis of intermediate polyvinyl acetate. Preferred polyvinyl alcohols and polyvinyl alcohols have degree of hydrolysis of 70 to 100 mol. %, preferably 80 to 90 mol. %, particularly preferably 81 to 89 mol. %, and in particular 82 to 88 mol. %.

Polyvinyl alcohol copolymers which include, in addition to vinyl alcohol, an ethylenically unsaturated carboxylic acid, or the salt or ester thereof, are preferred. Polyvinyl alcohol copolymers of this kind particularly preferably contain, in addition to vinyl alcohol, sulfonic salts such as 2-acrylamido-2-methyl-1-propane sulfonic acid (AMPS), acrylic acid, methacrylic acid, acrylic acid ester, methacrylic acid ester or mixtures thereof; of the esters, $C_{1-4}$ alkyl esters or $C_{1-4}$ hydroxyalkyl esters are preferred. Other suitable monomers are ethylenically unsaturated dicarboxylic acids, for example itaconic acid, maleic acid, fumaric acid and mixtures thereof.

Suitable water-soluble films for use in the wrappings of the water-soluble packagings according to the invention are films which are sold by MonoSol LLC, for example under the names M8630, M8720, M8310, C8400 or M8900. Other suitable films include films named Solublon® PT, Solublon® GA, Solublon® KC or Solublon® KL from Aicello Chemical Europe GmbH or the films VF-HP from Kuraray.

The water-soluble films can contain additional active ingredients or fillers, but also plasticizers and/or solvents, in particular water, as further ingredients.

The group of further active ingredients includes, for example, materials which protect the ingredients of the preparation (A) enclosed by the film material from decomposition or deactivation by light irradiation. Antioxidants, UV absorbers and fluorescent dyes have proven to be particularly suitable for this.

Glycerol, ethylene glycol, diethylene glycol, propanediol, 2-methyl-1,3-propanediol, sorbitol or mixtures thereof, for example, can be used as plasticizers.

To reduce its coefficient of friction, the surface of the water-soluble film of the washing agent portion unit can optionally be powder-coated with fine powder. Sodium aluminosilicate, silica, talc and amylose are examples of suitable powdering agents.

The deep-drawing apparatus used in the method can be operated continuously or discontinuously. A continuous procedure is preferred for increasing the efficiency of the method. In a particularly preferred embodiment of the method, the water-soluble film is continuously transported from step a) to step e).

As stated at the outset, the method according to the invention allows the efficient production of washing agent portion units at belt speeds of 0.04 m/s, preferably above 0.08 m/s. With regard to the economy and safety of the method, it is preferred for the first water-soluble film to be transported at a speed of from 0.08 to 0.3 m/s, preferably from 0.1 to 0.2 m/s, in step a).

In step b) of the method, the water-soluble film is molded into the cavity of a deep-drawing die. The molding can be preceded by optional pre-treatment of the film by heat and/or solvents. The water-soluble film can be molded into the cavity for example by means of a tool, by the action of a vacuum, by the action of compressed air and/or by the action of its own weight.

DETAILED DESCRIPTION OF THE INVENTION

Of the series of deep-drawing methods described, methods are preferred in which the water-soluble film is transported above the cavities of a deep-drawing die and is molded there into the recesses in the die by the action of compressed air on the upper side of the film or by the action of a vacuum on the underside of the film, particularly preferably by the simultaneous action of compressed air and vacuum. Particularly advantageous methods are characterized in that the film is pre-treated by the action of heat and/or solvents before the molding.

The action of heat and/or solvents on the water-soluble film facilitates the plastic deformation thereof. The film can be heated, for example, by heat radiation, hot air or, particularly preferably, by direct contact with a hotplate. The duration of the heat treatment as well as the temperature of the heat radiation, hot air or hotplate surface used is of course dependent on the type of shell material used. For water-soluble or water-dispersible materials such as PVA-containing polymers or copolymers, a temperature between 90 and 130° C., in particular between 105 and 115° C., is preferred. The duration of the heat treatment, in particular the contact time when using a hotplate, is preferably between 0.1 and 7 seconds, particularly preferably between 0.2 and 6 seconds and in particular between 0.3 and 4 seconds. Contact times below one second, in particular in the range of from 400 to 900 milliseconds, preferably between 500 and 800 milliseconds, have proven to be particularly advantageous for materials made of polyvinyl alcohol.

The deep-drawing die itself can be designed in the form of a horizontally rotating belt or in the form of a rotating drum.

The cavity formed in step b) preferably has an oval or circular opening, particularly preferably a circular opening.

The cavity formed in step b) preferably has a maximum diameter in the direction of travel of the film of between 3 and 40 mm, preferably between 3 and 20 mm and in particular between 3 and 15 mm. These diameters are particularly preferred for cavities having a circular opening.

The volume of the cavity formed in step b) is preferably from 0.5 to 30 $cm^3$, particularly preferably from 1 to 10 $cm^3$ and in particular from 1.5 to 4 $cm^3$. These volumes are particularly preferred for cavities having a circular opening.

In step c) of the method, the previously molded cavities are filled with a flowable washing agent preparation. The degree of filling of the cavity is preferably at least 60 vol. %, preferably at least 80 vol. % and in particular at least 90 vol. %. Such a high degree of filling reduces the proportion of water-soluble packaging film with respect to the total weight of the washing agent portion unit and improves the ecological profile of said film. Moreover, the visual impression thereof is also improved due to the smaller air bubble in the closed receiving chamber.

The washing agent preparation is flowable under standard conditions (20° C., 1013 mbar).

A first essential component of the washing agent preparation is the surfactant, which is contained in the washing agent preparation in an amount of 20 to 80 wt. %, preferably 30 to 75 wt. % and in particular 40 to 70 wt. %.

The group of surfactants includes the non-ionic, anionic, cationic and amphoteric surfactants. The group of surfactants also includes the co-surfactants described below. The compositions according to the invention can comprise one or more of the surfactants mentioned. Particularly preferred compositions contain at least one anionic surfactant as the surfactant.

The anionic surfactant is preferably selected from the group comprising $C_9$-$C_{13}$ alkylbenzene sulfonates, olefin sulfonates, $C_{12}$-$C_{18}$ alkane sulfonates, ester sulfonates, alk(en)yl sulfates, fatty alcohol ether sulfates and mixtures thereof. Compositions which comprise $C_9$-$C_{13}$ alkylbenzene sulfonates and fatty alcohol ether sulfates as the anionic surfactant have particularly good dispersing properties. Surfactants of the sulfonate type that can be used are preferably $C_9$-$C_{13}$ alkylbenzene sulfonates, olefin sulfonates, i.e. mixtures of alkene and hydroxyalkane sulfonates, and disulfonates, as obtained, for example, from $C_{12-18}$ monoolefins having a terminal or internal double bond by way of sulfonation with gaseous sulfur trioxide and subsequent alkaline or acid hydrolysis of the sulfonation products. $C_{12-18}$ alkane sulfonates and the esters of α-sulfofatty acids (ester sulfonates) are also suitable, for example the α-sulfonated methyl esters of hydrogenated coconut, palm kernel or tallow fatty acids.

The alkali salts and in particular the sodium salts of the sulfuric acid half-esters of $C_{12}$-$C_{18}$ fatty alcohols, for example from coconut fatty alcohol, tallow fatty alcohol, lauryl alcohol, myristyl alcohol, cetyl alcohol or stearyl alcohol, or of $C_{10}$-$C_{20}$ oxo alcohols and the half-esters of secondary alcohols having these chain lengths are preferred as alk(en)yl sulfates. From a washing perspective, $C_{12}$-$C_{16}$ alkyl sulfates, $C_{12}$-$C_{15}$ alkyl sulfates and $C_{14}$-$C_{15}$ alkyl sulfates are preferred. 2,3-alkyl sulfates are also suitable anionic surfactants.

The salts of the sulfuric acid half-esters of fatty alcohols having 12 to 18 C atoms, for example from coconut fatty alcohol, tallow fatty alcohol, lauryl alcohol, myristyl alcohol, cetyl alcohol or stearyl alcohol, or of the oxo alcohols having 10 to 20 C atoms and the half-esters of secondary alcohols having these chain lengths are preferred as alk(en)yl sulfates. From a washing perspective, the alkyl sulfates having 12 to 16 C atoms, alkyl sulfates having 12 to 15 C atoms and alkyl sulfates having 14 and 15 C atoms are preferred. 2,3-alkyl sulfates are also suitable anionic surfactants.

Fatty alcohol ether sulfates, such as the sulfuric acid monoesters of straight-chain or branched $C_7$-$C_{21}$ alcohols ethoxylated with 1 to 6 mol ethylene oxide, such as 2-methyl-branched C9-11 alcohols having, on average, 3.5 mol ethylene oxide (EO) or C12-18 fatty alcohols having 1 to 4 EO, are also suitable. Alkyl ether sulfates of formula (A-1) are preferred $$R^1—O—(AO)_n—SO_3^-X^+ \quad \text{(A-1)}$$

In this formula (A-1), $R^1$ represents a linear or branched, substituted or unsubstituted alkyl functional group, preferably a linear, unsubstituted alkyl functional group, particularly preferably a fatty alcohol functional group. Preferred functional groups $R^1$ of formula (A-1) are selected from decyl, undecyl, dodecyl, tridecyl, tetradecyl, pentadecyl, hexadecyl, heptadecyl, octadecyl, nonadecyl, eicosyl functional groups and mixtures thereof, the representatives having an even number of C atoms being preferred. Particularly preferred functional groups $R^1$ of formula (A-1) are derived from fatty alcohols having 12 to 18 C atoms, for example from coconut fatty alcohol, tallow fatty alcohol, lauryl, myristyl, cetyl or stearyl alcohol, or from oxo alcohols having 10 to 20 C atoms.

In formula (A-1), AO represents an ethylene oxide (EO) or propylene oxide (PO) group, preferably an ethylene oxide group. The index n in formula (A-1) is an integer of from 1 to 50, preferably from 1 to 20, and in particular from 2 to 10. Very particularly preferably, n is 2, 3, 4, 5, 6, 7 or 8. X is a monovalent cation or the n-th part of an n-valent cation, the alkali metal ions, including $Na^+$ or $K^+$, being preferred in this case, with $Na^+$ being most preferred. Further cations X+ may be selected from $NH_4^+$, ½ $Zn^{2+}$, ½ $Mg^{2+}$, ½ $Ca^{2+}$, ½ $Mn^{2+}$, and mixtures thereof.

Particularly preferred compositions contain an alkyl ether sulfate selected from fatty alcohol ether sulfates of formula A-2

(A-2)

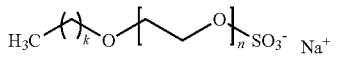

where k=11 to 19, and n=2, 3, 4, 5, 6, 7 or 8. Very particularly preferred representatives are Na fatty alcohol ether sulfates having 12 to 18 C atoms and 2 EO (k=11 to 13, n=2 in formula A-1). The degree of ethoxylation indicated represents a statistical average that can correspond to an integer or a fractional number for a specific product. The degrees of alkoxylation indicated represent statistical averages that can correspond to an integer or a fractional number for a specific product. Preferred alkoxylates/ethoxylates have a narrowed homolog distribution (narrow range ethoxylates, NRE).

In a particularly preferred embodiment, the composition contains $C_{9-13}$ alkylbenzene sulfonates and optionally also fatty alcohol ether sulfates as the anionic surfactant.

It is very particularly preferred for the composition to contain at least one anionic surfactant of formula (A-3)

(A-3)

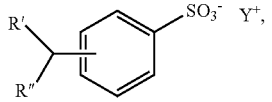

in which

R' and R" are, independently of one another, H or alkyl, and together contain 9 to 19, preferably 9 to 15 and in particular 9 to 13, C atoms, and $Y^+$ denotes a monovalent cation or the n-th part of an n-valent cation (in particular $Na^+$).

In summary, preferred washing agent preparations contain, as the surfactant, at least one anionic surfactant, preferably at least one anionic surfactant from the group consisting of $C_{8-18}$ alkylbenzene sulfonates, $C_{8-18}$ olefin sulfonates, $C_{12-18}$ alkane sulfonates, $C_{8-18}$ ester sulfonates, $C_{8-18}$ alkyl sulfates, $C_{8-18}$ alkenyl sulfates, fatty alcohol ether sulfates, in particular at least one anionic surfactant from the group of $C_{8-18}$ alkylbenzene sulfonates.

The proportion by weight of the anionic surfactant with respect to the total weight of the first flowable washing agent preparation is preferably 20 to 60 wt. % and in particular 22 to 50 wt. %.

In addition to the surfactant described above, the flowable washing agent preparation contains fatty acid as a second essential component. For the optical properties, the viscosity profile and the cleaning performance of the preparation, it has proven advantageous for the first flowable washing agent preparation to contain, based on the total weight thereof, 4 to 12 wt. %, preferably 6 to 10 wt. %, fatty acid.

Preferred fatty acids are selected from the group of caprylic acid, capric acid, lauric acid, myristic acid, palmitic acid, stearic acid, oleic acid, linoleic acid and mixtures thereof.

As a third essential component, the flowable washing agent preparation contains the salt of a divalent cation. The proportion by weight of this salt with respect to the total weight of the first flowable washing agent preparation is preferably 0.4 to 6 wt. % and in particular 0.5 to 4 wt. %.

These proportions by weight have proven to be advantageous in terms of both the appearance and the viscosity of the preparation.

Because of their availability, magnesium or calcium salts are particularly preferably used, the salt of a divalent cationbeing particularly preferably selected from the group of the salts of divalent metal cations, in particular of magnesium and calcium salts, preferably from the group of magnesium chloride, magnesium sulfate, calcium chloride and calcium sulfate.

Preferred salts have a solubility in water (20° C.) above 400 g/l. The use of salts from the group of magnesium chloride and calcium chloride is very particularly preferred.

The washing agent preparation contains a solvent as a fourth essential component. The proportion by weight of the solvent with respect to the total weight of the washing agent preparation is preferably 12 to 32 wt. % and in particular 15 to 30 wt. %. With regard to processability, in particular the dosing ability of the washing agent preparation in the method according to the invention, it has proven to be advantageous for the first flowable washing agent preparation to contain, based on the total weight thereof, 7 to 20 wt. %, preferably 10 to 18 wt. %, organic solvent.

Preferred organic solvents are selected from the group of ethanol, n-propanol, i-propanol, butanols, glycol, propanediol, butanediol, methylpropanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol mono methyl ether, dipropylene glycol mono ethyl ether, methoxytriglycol, ethoxytriglycol, butoxytriglycol, 1-butoxyethoxy-2-propanol, 3-methyl-3-methoxybutanol, propylene-glycol-t-butylether, di-n-octylether and mixtures thereof, preferably from the group of propanediol, glycerol and mixtures thereof.

The liquid washing agent preparations are preferably low-water substance mixtures. Flowable washing agent preparations of this kind which contain, based on the total weight thereof, less than 18 wt. %, preferably less than 15 wt. %, water are preferred.

In summary, methods are particularly preferred in the course of which a first flowable washing agent preparation is filled into the cavity in step c), which washing agent preparation contains, based on the total weight thereof, i) 20 to 80 wt. % surfactant including 25 to 50 wt. % anionic surfactant;
ii) 4 to 12 wt. % fatty acid;
iii) 0.5 to 4 wt. % of the salt of a divalent metal cation;
iv) 8 to 35 wt. % solvent.

The composition of some preferably produced flowable washing agent preparations can be derived from the following tables (amounts given in wt. % based on the total weight of the preparation, unless otherwise indicated).

| | Formula 1 | Formula 2 | Formula 3 | Formula 4 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 6 | Formula 7 | Formula 8 | Formula 9 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 11 | Formula 12 | Formula 13 | Formula 14 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 16 | Formula 17 | Formula 18 | Formula 19 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |

-continued

| | Formula 16 | Formula 17 | Formula 18 | Formula 19 |
|---|---|---|---|---|
| Magnesium chloride, calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

10

| | Formula 21 | Formula 22 | Formula 23 | Formula 24 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 26 | Formula 27 | Formula 28 | Formula 29 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 31 | Formula 32 | Formula 33 | Formula 34 |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

50

| | Formula 36 | Formula 37 | Formula 38 | Formula 39 |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

* preferably $C_{8-18}$ alkylbenzene sulfonates

In a technically advantageous variant of the method according to the invention, the first flowable washing agent preparation also contains, based on the total weight thereof, v) 0.5 to 4 wt. %, preferably 0.5 to 3 wt. % and in particular 0.5 to 2 wt. %, of the salt of a monovalent cation.

By adding the monovalent cation, the cloudy-white appearance of the washing agent preparation is enhanced. At the same time, the resulting compositions are distinguished by viscosity properties that are optimal for the procedure. In particular, the addition of the monovalent cation in large proportions by weight causes sufficient turbidity without increasing the viscosity of the washing agent preparation in a manner which makes it difficult to convey said preparation in pipe systems and dose said preparation in step c). Finally, the addition of the salt of a monovalent cation reduces the temperature dependence of the viscosity of the flowable washing agent preparation and thus simplifies the processing thereof.

The use of monovalent metal salts, in particular the use of sodium chloride, also improves the storage stability, in particular the storage stability in the event of temperature fluctuations.

Preferred monovalent cations are selected from the group of monovalent metal cations. Because of their availability and low costs, preferred salts of monovalent cations are selected from the group of sodium chloride, potassium chloride, sodium sulfate, sodium carbonate, potassium sulfate, potassium carbonate, sodium hydrogen carbonate, potassium hydrogen carbonate, very preferably from the group of sodium chloride.

In summary, a second particularly preferred embodiment of the method is characterized in that a first flowable washing agent preparation is filled into the cavity in step c), which washing agent preparation contains, based on the total weight thereof, i) 20 to 80 wt. % surfactant including 20 to 50 wt. % anionic surfactant;

ii) 4 to 12 wt. % fatty acid;

iii) 0.5 to 4 wt. % of the salt of a divalent metal cation;

iv) 8 to 35 wt. % solvent;

v) 0.5 to 4 wt. % of the salt of a monovalent metal cation.

The composition of some other particularly preferably produced flowable washing agent preparations can be derived from the following tables (amounts given in wt. % based on the total weight of the preparation, unless otherwise indicated).

| | Formula 1a | Formula 2a | Formula 3a | Formula 4a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 6a | Formula 7a | Formula 8a | Formula 9a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 11a | Formula 12a | Formula 13a | Formula 14a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 16a | Formula 17a | Formula 18a | Formula 19a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |

-continued

| | Formula 16a | Formula 17a | Formula 18a | Formula 19a |
|---|---|---|---|---|
| Magnesium chloride, calcium chloride | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 21a | Formula 22a | Formula 23a | Formula 24a |
|---|---|---|---|---|
| Surfactant | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 26a | Formula 27a | Formula 28a | Formula 29a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 31a | Formula 32a | Formula 33a | Formula 34a |
|---|---|---|---|---|
| Surfactant | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 36a | Formula 37a | Formula 38a | Formula 39a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Solvent | 8 to 35 | 12 to 32 | 12 to 32 | 15 to 30 |
| Misc. | to make up to 100 | to make up to 100 | to make up to 100 | to make up to 100 |

| | Formula 41a | Formula 42a | Formula 43a | Formula 44a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 46a | Formula 47a | Formula 48a | Formula 49a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Salt of a monovalent cation | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 51a | Formula 52a | Formula 53a | Formula 54a |
|---|---|---|---|---|
| Surfactant | 20 to 80 | 30 to 75 | 30 to 75 | 40 to 70 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 56a | Formula 57a | Formula 58a | Formula 59a |
|---|---|---|---|---|
| Total surfactant | 20 to 80 | 30 to 75 | 30 to 75 | 40 to 70 |
| Anionic surfactant * | 20 to 60 | 20 to 60 | 20 to 50 | 20 to 50 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Sodium chloride | 0.5 to 4 | 0.5 to 3 | 0.5 to 3 | 0.5 to 2 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

* preferably $C_{8-18}$ alkylbenzene sulfonates

In a further technically advantageous variant of the method according to the invention, the first flowable washing agent preparation contains, based on the total weight thereof, 12 to 30 wt. %, preferably 15 to 25 wt. %, non-ionic surfactant and particularly preferably also 0.3 to 5 wt. % of a non-ionic co-surfactant that differs from the non-ionic surfactant.

Preferred non-ionic surfactants are selected from the group of alkoxylated primary $C_{8-18}$ alcohols having a degree of alkoxylation of ≥4, particularly preferably the $C_{12-14}$ alcohols having 4 EO or 7 EO, the $C_{9-11}$ alcohols having 7 EO, the $C_{13-15}$ alcohols having 5 EO, 7 EO or 8 EO, the $C_{13-15}$ oxo alcohols having 7 EO, the $C_{12-18}$ alcohols having 5 EO or 7 EO, the $C_{13-15}$ oxo alcohols having 7 EO, in particular the primary $C_{12-18}$ alcohols having a degree of alkoxylation of ≥4, very particularly preferably the primary $C_{12-18}$ alcohols having 7 EO.

With regard to the rheological properties of the first flowable washing agent preparation and the processability thereof, it has proven to be advantageous to use anionic surfactant and non-ionic surfactant in a weight ratio of from 3:1 to 1:2, preferably from 2:1 to 1:1.5 and in particular from 1.4:1 to 1:1.

It has proven to be technically advantageous to supplement the previously described surfactant system consisting of anionic and non-ionic surfactant with a further co-surfactant. The proportion by weight of the co-surfactant with respect to the total weight of the flowable washing agent preparation is preferably 0.3 to 5 wt. %. Preferred co-surfactants are selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3.

In summary, a third particularly preferred embodiment of the method is characterized in that a first flowable washing agent preparation is filled into the cavity in step c), which washing agent preparation contains, based on the total weight thereof, i) 32.3 to 80 wt. % surfactant including 20 to 50 wt. % anionic surfactant and 12 to 30 wt. % non-ionic surfactant;

ii) 4 to 12 wt. % fatty acid;

iii) 0.5 to 4 wt. % of the salt of a divalent cation;

iv) 8 to 35 wt. % solvent v) 0.3 to 5 wt. % of a co-surfactant that differs from the non-ionic surfactant and is selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3.

The composition of some other particularly preferably produced flowable washing agent preparations can be derived from the following tables (amounts given in wt. % based on the total weight of the preparation, unless otherwise indicated).

| | Formula 1b | Formula 2b | Formula 3b | Formula 4b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 6b | Formula 7b | Formula 8b | Formula 9b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 11b | Formula 12b | Formula 13b | Formula 14b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 16b | Formula 17b | Formula 18b | Formula 19b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant | 12 to 30 | 12 to 30 | 15 to 25 | 15 to 25 |
| Co-surfactant ** | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 21b | Formula 22b | Formula 23b | Formula 24b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |
| Co-surfactant **** | 0.3 to 5 | 0.3 to 5 | 0.5 to 4 | 0.5 to 4 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 26b | Formula 27b | Formula 28b | Formula 29b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |
| Co-surfactant **** | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Solvent | 8 to 35 | 12 to 32 | 12 to 32 | 15 to 30 |
| Misc. | to make up to 100 | to make up to 100 | to make up to 100 | to make up to 100 |

| | Formula 31b | Formula 32b | Formula 33b | Formula 34b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |
| Co-surfactant **** | 0.3 to 5 | 0.3 to 5 | 0.5 to 4 | 0.5 to 4 |
| Fatty acid | 2 to 15 | 4 to 12 | 4 to 12 | 6 to 10 |
| Salt of a divalent cation | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 36b | Formula 37b | Formula 38b | Formula 39b |
|---|---|---|---|---|
| Total surfactant | 32.3 to 80 | 32.3 to 75 | 35.5 to 75 | 40 to 70 |
| Anionic surfactant * | 20 to 60 | 20 to 60 | 20 to 50 | 20 to 50 |
| Non-ionic surfactant *** | 12 to 30 | 12 to 30 | 15 to 25 | 15 to 25 |
| Co-surfactant **** | 0.3 to 5 | 0.3 to 5 | 0.5 to 4 | 0.5 to 4 |

-continued

| | Formula 36b | Formula 37b | Formula 38b | Formula 39b |
|---|---|---|---|---|
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

| | Formula 41b | Formula 42b | Formula 43b | Formula 44b |
|---|---|---|---|---|
| Total surfactant | 32.3 to 80 | 32.3 to 75 | 35.5 to 75 | 40 to 70 |
| $C_{8-18}$ alkylbenzene sulfonate | 20 to 60 | 20 to 60 | 20 to 50 | 20 to 50 |
| Primary $C_{12-18}$ alcohols with 7 EO | 12 to 30 | 12 to 30 | 15 to 25 | 15 to 25 |
| $C_{13}$ alcohols with 2 EO or 3 EO | 0.3 to 5 | 0.3 to 5 | 0.5 to 4 | 0.5 to 4 |
| Fatty acid | 2 to 15 | 4 to 12 | 4 to 12 | 6 to 10 |
| Magnesium chloride, calcium chloride | 0.3 to 8 | 0.3 to 8 | 0.4 to 6 | 0.5 to 4 |
| Total solvent | 8 to 35 | 12 to 32 | 12 to 32 | 15 to 30 |
| Organic solvent | 7 to 20 | 7 to 20 | 10 to 18 | 10 to 18 |
| Water | <18 | <18 | <15 | <15 |
| Misc. | to make up to 100 | to make up to 100 | to make up to 100 | to make up to 100 |

* preferably $C_{8-18}$ alkylbenzene sulfonates

** co-surfactant that differs from the non-ionic surfactant and is selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, diglycerol ethers of $C_8$-$C_{18}$ fatty alcohols, in particular from the group of alkoxylated primary $C_{12}$-$C_{18}$ alcohols having a degree of alkoxylation of ≤3

*** primary $C_{12-18}$ alcohols having a degree of alkoxylation of ≥4, preferably primary $C_{12-18}$ alcohols having 7 EO

**** alkoxylated primary $C_{12}$-$C_{18}$ alcohols having a degree of alkoxylation of ≤3, preferably $C_{13}$ alcohols having 2 EO or 3 EO The first flowable washing agent preparation used in the method preferably has a viscosity (21° C., Brookfield viscometer type DV-II Pro, spindle no. 2, 20 rpm) above 400 mPas, preferably above 1000 mPas.

The flowable washing agent preparation is preferably designed in the form of a structured system. The main types of structured system used in practice are based on dispersed lamellar, spherulitic and attenuated lamellar phases. The flowable washing agent preparation preferably contains a spherulitic phase. Spherulitic phases comprise spherical bodies, commonly referred to in the art as spherulites, in which surfactant bilayers are arranged as concentric shells. The spherulites are dispersed in an aqueous phase in the manner of a classic emulsion, and interact to form a structured system. Preferred flowable washing agent preparations comprise lamellar spherulites, preferably having a maximum diameter of from 10 to 100 μm, particularly preferably having a maximum diameter of from 25 to 50 μm.

The first flowable washing agent preparation preferably has a yield point (TA Instruments rotation rheometer AR 2000, 20° C., cone plate with 40 mm diameter, 2° cone angle) above 0.1 Pa, preferably above 0.3 Pa.

The rheological properties of the first flowable washing agent preparation justify its efficient processability in the method according to the invention and also form the basis of its advantageous optical properties, including its cloudy-white appearance.

The Nephelometric Turbidity Unit (NTU) is frequently used as an indication of transparency. It is a unit, used e.g. in water treatment, for measuring turbidity e.g. in liquids. It is a unit of turbidity measured using a calibrated nephelometer. High NTU values are measured for clouded compositions, whereas low values are determined for clear compositions.

The HACH Turbidimeter 2100Q from Hach Company, Loveland, Colo. (USA) is used with the calibration substances StabICal Solution HACH (20 NTU), StabICal Solution HACH (100 NTU) and StabICal Solution HACH (800 NTU), all of which can also be produced by Hach Company. The measurement is filled with the composition to be analyzed in a 10 ml measuring cuvette having a cap and is carried out at 20° C.

At an NTU value (at 20° C.) of 60 or more, shaped bodies have a perceptible turbidity within the meaning of the invention, as can be seen with the naked eye. The turbidity (HACH Turbidimeter 2100Q, 20° C., 10 ml cuvette) of the liquid, surfactant-containing washing agent is preferably above 60 NTU, particularly preferably above 100 NTU and in particular above 400 NTU.

The flowable washing agent preparation is preferably free from organic opacifying agents. "Free from," as used in this context, means that the corresponding constituent is present in the preparation in an amount of <1 wt. %, preferably <0.1 wt. %, more preferably <0.01 wt. %. In particular, a constituent of this kind is not deliberately added. The flowable washing agent preparations preferably contain in particular no styrene-acrylate copolymers (INCI: styrene/acrylates copolymer).

The flowable washing agent preparation can be free from enzymes and/or fragrances. These constituents are in particular not contained because they can adversely affect the turbidity and thus the appearance of the formulation.

For example, flowable washing agent preparations which contain, based on the total weight thereof, less than 2 wt. %, preferably less than 1 wt. %, particularly preferably less than 0.1 wt. % and in particular no enzyme preparation are preferred.

Flowable washing agent preparations which contain, based on the total weight thereof, less than 2 wt. %, preferably less than 1 wt. %, particularly preferably less than 0.1 wt. % and in particular no fragrance are also preferred.

In an alternative embodiment, the first flowable washing agent preparation contains at least one optical brightener, preferably a stilbene-type optical brightener. This is contained in the flowable washing agent preparation, based on the total weight thereof, in an amount above 0 wt. %, but preferably in an amount below 1 wt. %, particularly preferably in an amount below 0.6 wt. %. Stilbene-type brighteners for use in the flowable washing agent preparation are preferably selected from the group of triazinyl derivatives of 4,4'-diamino-2,2'-stilbenesulfonic acid. The economically most important stilbene derivatives are DAS1 (disodium 4,4-bis[(4-anilino-6-morpholino-1,3,5-triazin-2-yl)amino] stilbene-2,2-disulfonate) and DSBP (disodium 4,4-bis(2-sulfostyryl)biphenyl).

Alternatively or additionally, the first flowable washing agent preparation can comprise at least one blue or violet dye. This is contained in the flowable washing agent preparation, based on the total weight thereof, in an amount above 0 wt. %, but preferably in an amount below 0.1 wt. %, particularly preferably below 0.02 wt. %, for example between 0.001 and 0.01 wt. %. A dye of this kind is used, for example, for the purpose of masking a possible yellowish hue in the preparation.

In step d), the water-soluble film provided with the filled cavities is transported in the direction of a sealing station. The speed of the film transport is preferably 0.08 to 0.3 m/s, particularly preferably 0.1 to 0.2 m/s.

In the subsequent step e), the filled cavities are sealed with a second water-soluble film. This second water-soluble film may be identical to the first water-soluble film, but preferably differs from this first film with regard to the composition or thickness thereof.

Following the sealing, the filled cavities (receiving chambers) are preferably separated into washing agent portion units. These washing agent portion units can have a single filled receiving chamber, but preferably have at least two, particularly preferably at least three filled receiving chambers.

The plurality of receiving chambers of the washing agent portion unit can be arranged spatially one next to the other or one above the other (stacked). While the method according to the invention can be used, in principle, to produce both designs, the technical advantages of the method according to the invention are particularly noticeable when producing washing agent portion units having receiving chambers arranged one next to the other. On the one hand, the specific rheological properties of the first flowable washing agent preparation allow rapid and non-dripping dosing even in the smallest of cavities and, on the other hand, the horizontal arrangement of the receiving chambers increases the visibility of the cloudy-white washing agent preparation.

These technical advantages are particularly evident in methods in which washing agent portion units comprising receiving chambers which enclose one another at least in part are produced. In preferred embodiments of the method, the washing agent portion unit has at least two receiving chambers which enclose one another at least in part. It is also very particularly preferred if the washing agent portion unit has at least one further receiving chamber which is filled with a colored washing agent preparation.

In a specific method variant, the washing agent portion unit comprises a plurality of receiving chambers, each of which is enclosed by at least one water-soluble film, wherein the receiving chambers are formed by water-soluble films connected to one another in a sealing plane and are separated from one another by sealing portions in the sealing plane and wherein the receiving chambers are each filled with a washing agent preparation, wherein a plurality of receiving chambers having the number $n \geq 2$ are provided, wherein the receiving chambers are arranged in at least one sectional plane about a common n-fold axis of rotation that is perpendicular to the sectional plane and wherein at least one central chamber arranged in the central region of the washing agent portion unit is provided, which central chamber is filled with a washing agent preparation, and the receiving chambers are arranged around the central chamber, wherein the central chamber is filled with a first flowable washing agent preparation.

Preferred embodiments of these method variants are characterized in that (i) the receiving chambers in the sealing plane have the same base surfaces and in that the base surfaces are arranged in the sealing plane about a common n-fold axis of rotation that is perpendicular to the sealing plane; and/or (ii) the washing agent portion unit has between 2 and ten receiving chambers, preferably between 3 and 5 receiving chambers; and/or (iii) the receiving chambers are arranged in at least one sectional plane about a 3- to 9-fold axis of rotation, preferably about a 3- or 4- or 5-fold axis of rotation; and/or (iv) the receiving chambers are arranged in at least one sectional plane about a central axis of rotation;

(v) at least two receiving chambers, preferably all receiving chambers, have the same filling volume and/or the same spatial shape; and/or (vi) the central chamber is separated from each receiving chamber by a sealing portion and in that the central chamber is at an equal distance from each receiving chamber; and/or (vii) the minimum width of the sealing portion between a receiving chamber and the central chamber is less than 5 mm, preferably less than 3 mm, more preferably less than 2 mm; and/or (viii) the central chamber has a base surface in the sealing plane and in that the base surface has circular symmetry or n-fold rotational symmetry with n as the number of receiving chambers; and/or (ix) the central chamber has a circular base surface or a polygonal base surface, preferably a square, triangular, star-shaped, propeller-shaped or fan-wheel-shaped base surface.

Preferred methods are in particular characterized in that the washing agent portion unit has a base surface in the sealing plane and in that the base surface is axially asymmetrical.

This application also relates to a washing agent portion unit which was produced using the method described above.

This application provides the following subjects, inter alia:

1. A method for producing a washing agent portion unit having at least one filled receiving chamber surrounded by a water-soluble film, comprising the steps of:
   a) transporting a first water-soluble film in the direction of a dosing station at a speed of 0.04 m/s, preferably above 0.08 m/s;
   b) molding the first water-soluble film into the cavities of a deep-drawing die located below the water-soluble film, so as to form at least one cavity having a maximum diameter in the direction of travel of the film of between 3 and 75 mm;
   c) filling the cavity by means of the dosing station with a first flowable washing agent preparation containing, based on its total weight,
      i) 20 to 80 wt. % surfactant;
      ii) 2 to 15 wt. % fatty acid;
      iii) 0.3 to 8 wt. % of the salt of a divalent cation;
      iv) 8 to 35 wt. % solvent;
   d) further transporting the filled cavity in the direction of a sealing station at a speed of 0.04 m/s, preferably above 0.08 m/s;
   e) sealing the filled cavity with a second water-soluble film.
2. The method according to point 1, wherein the water-soluble film is continuously transported from step a) to step e).
3. The method according to one of the preceding points, wherein the first water-soluble film is transported at a speed of from 0.08 to 0.3 m/s, preferably from 0.1 to 0.2 m/s, in step a).
4. The method according to one of the preceding points, wherein the water-soluble film is molded into the deep-drawing die of a horizontally rotating belt in step b).
5. The method according to one of the preceding points, wherein the water-soluble film is molded into the deep-drawing die of a rotating drum in step b).
6. The method according to one of the preceding points, wherein the cavity formed in step b) has an oval or circular opening, preferably a circular opening.
7. The method according to one of the preceding points, wherein the cavity formed in step b) has a maximum diameter in the direction of travel of the film of between 3 and 40 mm, preferably between 3 and 20 mm and in particular between 30 and 15 mm.
8. The method according to one of the preceding points, wherein the cavity formed in step b) has a volume of from 0.5 to 30 $cm^3$, preferably from 1 to 10 $cm^3$ and in particular from 1.5 to 4 $cm^3$.
9. The method according to one of the preceding points, wherein the cavity in step c) is filled to at least 60 vol. %, preferably to at least 80 vol. % and in particular to at least 90 vol. %.
10. The method according to one of the preceding points, wherein the first flowable washing agent preparation contains, based on the total weight thereof, 30 to 75 wt. %, preferably 40 to 70 wt. %, surfactant.
11. The method according to one of the preceding points, wherein the first flowable washing agent preparation contains, based on the total weight thereof, 20 to 60 wt. %, preferably 20 to 50 wt. %, anionic surfactant.
12. The method according to one of the preceding points, wherein at least one anionic surfactant, preferably at least one anionic surfactant from the group consisting of $C_{8-18}$ alkylbenzene sulfonates, $C_{8-18}$ olefin sulfonates, $C_{12-18}$ alkanesulfonates, $C_{8-18}$ ester sulfonates, $C_{8-18}$ alkyl sulfates, $C_{8-18}$ alkenyl sulfates, fatty alcohol ether sulfates, in particular at least one anionic surfactant from the group of $C_{8-18}$ alkyl benzene sulfonates, is contained as the surfactant.
13. The method according to one of the preceding points, wherein the first flowable washing agent preparation contains, based on the total weight thereof, 4 to 12 wt. %, preferably 6 to 10 wt. %, fatty acid.
14. The method according to one of the preceding points, wherein the fatty acid is selected from the group of caprylic acid, capric acid, lauric acid, myristic acid, palmitic acid, stearic acid, oleic acid, linoleic acid and mixtures thereof.
15. The method according to one of the preceding points, wherein the first flowable detergent preparation contains, based on its total weight, 0.4 to 6 wt. %, preferably 0.5 to 4 wt. %, of the salt of a divalent cation.
16. The method according to one of the preceding points, wherein the salt of a divalent cationis selected from the group of the salts of divalent metal cations, in particular of magnesium and calcium salts, preferably from the group of magnesium chloride, magnesium sulfate, calcium chloride and calcium sulfate, very particularly preferably from the group of magnesium chloride and calcium chloride.
17. The method according to one of the preceding points, wherein the first flowable washing agent preparation contains, based on its total weight,
   i) 20 to 80 wt. % surfactant including 20 to 50 wt. % anionic surfactant;
   ii) 4 to 12 wt. % fatty acid;
   iii) 0.5 to 4 wt. % of the salt of a divalent metal cation;
   iv) 8 to 35 wt. % solvent.
18. The method according to one of the preceding points, wherein the first flowable washing agent preparation contains, based on the total weight thereof, 12 to 32 wt. %, preferably 15 to 30 wt. %, solvent.
19. The method according to one of the preceding points, wherein the first flowable washing agent preparation contains, based on the total weight thereof, 7 to 20 wt. %, preferably 10 to 18 wt. %, organic solvent.
20. The method according to one of the preceding points, wherein the organic solvent is selected from the group of ethanol, n-propanol, i-propanol, butanols, glycol, propanediol, butanediol, methylpropanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol mono methyl ether, dipropylene glycol mono ethyl ether, methoxytriglycol, ethoxytriglycol, butoxytriglycol, 1-butoxyethoxy-2-propanol, 3-methyl-3-methoxybutanol, propylene-glycol-t-butylether, di-n-octylether and mixtures thereof, preferably from the group of propanediol, glycerol and mixtures thereof.
21. The method according to one of the preceding points, wherein the first flowable washing agent preparation contains, based on its total weight, less than 18 wt. %, preferably less than 15 wt. %, water.
22. The method according to one of the preceding points, wherein the first flowable washing agent preparation further contains, based on its total weight,
   v) 0.5 to 4 wt. %, preferably 0.5 to 3 wt. %, and in particular 0.5 to 2 wt. %, of the salt of a monovalent cation.

23. The method according to point 22, wherein the salt of a monovalent cation is selected from the group of the salts of monovalent metal cations, preferably from the group of sodium chloride, potassium chloride, sodium sulfate, sodium carbonate, potassium sulfate, potassium carbonate, sodium hydrogen carbonate, potassium hydrogen carbonate, very preferably from the group of sodium chloride.
24. The method according to one of the preceding points, wherein the first flowable washing agent preparation contains, based on its total weight,
    i) 20 to 80 wt. % surfactant including 20 to 50 wt. % anionic surfactant;
    ii) 4 to 12 wt. % fatty acid;
    iii) 0.5 to 4 wt. % of the salt of a divalent metal cation;
    iv) 8 to 35 wt. % solvent;
    v) 0.5 to 4 wt. % of the salt of a monovalent metal cation.
25. The method according to one of the preceding points, wherein the first flowable washing agent preparation contains, based on the total weight thereof, 12 to 30 wt. %, preferably 15 to 25 wt. %, non-ionic surfactant.
26. The method according to one of the preceding points, wherein at least one non-ionic surfactant from the group of alkoxylated primary $C_{8-18}$ alcohols having a degree of alkoxylation of ≥4, particularly preferably the $C_{12-14}$ alcohols having 4 EO or 7 EO, the $C_{9-11}$ alcohols having 7 EO, the $C_{13-15}$ alcohols having 5 EO, 7 EO or 8 EO, the $C_{13-15}$ oxo alcohols having 7 EO, the $C_{12-18}$ alcohols having 5 EO or 7 EO, the $C_{13-15}$ oxo alcohols having 7 EO, in particular the primary $C_{12-18}$ alcohols having a degree of alkoxylation of ≥4, very particularly preferably the primary $C_{12-18}$ alcohols having 7 EO, is contained as a surfactant.
27. The method according to one of the preceding points, wherein the first flowable washing agent preparation contains anionic surfactant and non-ionic surfactant in a weight ratio of from 3:1 to 1:2, preferably from 2:1 to 1:1.5 and in particular from 1.4:1 to 1:1.
28. The method according to one of the preceding points, wherein the first flowable washing agent preparation further contains, based on its total weight,
    vi) 0.3 to 5 wt. % of a co-surfactant selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3.
29. The method according to one of the preceding points, wherein the first flowable washing agent preparation contains, based on its total weight,
    i) 32.3 to 80 wt. % surfactant including 20 to 50 wt. % anionic surfactant and 12 to 30 wt. % non-ionic surfactant;
    ii) 4 to 12 wt. % fatty acid;
    iii) 0.5 to 4 wt. % of the salt of a divalent cation;
    iv) 8 to 35 wt. % solvent
    v) 0.3 to 5 wt. % of a co-surfactant that differs from the non-ionic surfactant and is selected from the group consisting of alkoxylated primary $C_8$-$C_{18}$ alcohols having a degree of alkoxylation of ≤3, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, monoglycerol ethers of $C_8$-$C_{18}$ fatty alcohols, in particular from the group of alkoxylated primary $C_{12}$-$C_{18}$ alcohols having a degree of alkoxylation of ≤3.
30. The method according to one of the preceding points, wherein the first flowable washing agent preparation does not contain any organic opacifying agents, in particular does not contain any styrene-acrylate copolymer.
31. The method according to one of the preceding points, wherein the first flowable washing agent preparation contains, based on its total weight, less than 2 wt. %, preferably less than 1 wt. %, particularly preferably less than 0.1 wt. % and in particular no enzyme preparation.
32. The method according to one of the preceding points, wherein the first flowable washing agent preparation contains, based on its total weight, less than 2 wt. %, preferably less than 1 wt. %, particularly preferably less than 0.1 wt. % and in particular no fragrance.
33. The method according to one of the preceding points, wherein the first flowable washing agent preparation contains, based on its total weight, an optical brightener, preferably a stilbene-type optical brightener, in amounts below 1 wt. %, preferably in amounts below 0.6 wt. %.
34. The method according to point 33, wherein the optical brightener is selected from the group of triazinyl derivatives of 4,4'-diamino-2,2'-stilbenesulfonic acid, in particular DAS1 (disodium 4,4-bis[(4-anilino-6-morpholino-1,3,5-triazin-2-yl)amino]stilbene-2,2-disulfonate) and DSBP (disodium 4,4-bis (2-sulfostyryl)biphenyl).
35. The method according to one of the preceding points, wherein the first flowable washing agent preparation contains, based on its total weight, a blue or violet dye in amounts below 0.1 wt. %, preferably below 0.02 wt. %.
36. The method according to one of the preceding points, wherein the first flowable washing agent preparation has a viscosity (21° C., Brookfield viscometer type DV-II Pro, spindle no. 2, 20 rpm) above 400 mPas, preferably above 1000 mPas.
37. The method according to one of the preceding points, wherein the first flowable washing agent preparation has a yield point (TA Instruments rotation rheometer AR 2000, 20° C., cone plate with 40 mm diameter, 2° cone angle) above 0.1 Pa, preferably above 0.3 Pa.
38. The method according to one of the preceding points, wherein the first flowable washing agent preparation has a turbidity (HACH Turbidimeter 2100Q, 20° C., 10 ml cuvette) above 60 NTU, preferably above 100 NTU and in particular above 400 NTU.
39. The method according to one of the preceding points, wherein the first flowable washing agent preparation contains lamellar spherulites, preferably having a maximum diameter of from 10 to 100 μm, particularly preferably having a maximum diameter of from 25 to 50 μm.
40. The method according to one of the preceding points, wherein the first water-soluble film is transported at a speed of from 0.08 to 0.3 m/s, preferably from 0.1 to 0.2 m/s, in step d).
41. The method according to one of the preceding points, wherein the washing agent portion unit has at least two receiving chambers.
42. The method according to one of the preceding points, wherein the washing agent portion unit has at least three receiving chambers.
43. The method according to one of the preceding points, wherein the washing agent portion unit has at least two receiving chambers which enclose one another at least in parts.
44. The method according to one of the preceding points, wherein the washing agent portion unit has at least one further receiving chamber, which is filled with a colored washing agent preparation.

45. The method according to one of the preceding points, wherein the washing agent portion unit comprises a plurality of receiving chambers, each of which is enclosed by at least one water-soluble film, wherein the receiving chambers are formed by water-soluble films connected to one another in a sealing plane and are separated from one another by sealing portions in the sealing plane and wherein the receiving chambers are each filled with a washing agent preparation, wherein a plurality of receiving chambers having the number n≥2 are provided, wherein the receiving chambers are arranged in at least one sectional plane about a common n-fold axis of rotation that is perpendicular to the sectional plane and wherein at least one central chamber arranged in the central region of the washing agent portion unit is provided, which central chamber is filled with a washing agent preparation, and the receiving chambers are arranged around the central chamber, wherein the central chamber is filled with a first flowable washing agent preparation.

46. The method according to point 45, wherein
   (i) the receiving chambers in the sealing plane have the same base surfaces and wherein the base surfaces are arranged in the sealing plane about a common n-fold axis of rotation that is perpendicular to the sealing plane; and/or
   (ii) the washing agent portion unit has between 2 and ten receiving chambers, preferably between 3 and 5 receiving chambers; and/or
   (iii) the receiving chambers are arranged in at least one sectional plane about a 3- to 9-fold axis of rotation, preferably about a 3- or 4- or 5-fold axis of rotation; and/or
   (iv) the receiving chambers are arranged in at least one sectional plane about a central axis of rotation;
   (v) at least two receiving chambers, preferably all receiving chambers, have the same filling volume and/or the same spatial shape; and/or
   (vi) the central chamber is separated from each receiving chamber by a sealing portion and wherein the central chamber is at an equal distance from each receiving chamber; and/or
   (vii) the minimum width of the sealing portion between a receiving chamber and the central chamber is less than 5 mm, preferably less than 3 mm, more preferably less than 2 mm; and/or
   (viii) the central chamber has a base surface in the sealing plane and wherein the base surface has circular symmetry or n-fold rotational symmetry with n as the number of receiving chambers; and/or
   (ix) the central chamber has a circular base surface or a polygonal base surface, preferably a square, triangular, star-shaped, propeller-shaped or fan-wheel-shaped base surface.

47. The method according to one of points 45 or 46, wherein the washing agent portion unit has a base surface in the sealing plane and wherein the base surface is axially asymmetrical.

48. A washing agent portion unit produced by a method according to one of points 1 to 47.

What is claimed is:

1. A method for producing an opacified washing agent portion unit having at least one filled receiving chamber surrounded by a water-soluble film, comprising the steps of:
   a) transporting a first water-soluble film in the direction of a dosing station at a speed above 0.04 m/s;
   b) molding the first water-soluble film into cavities of a deep-drawing die located below the water-soluble film, so as to form at least one cavity having a maximum diameter in the direction of travel of the film of between 3 and 75 mm;
   c) filling the cavity by means of the dosing station with a first flowable washing agent preparation containing, based on its total weight,
      i) 20 to 80 wt. % surfactant consisting of anionic surfactant and non-ionic surfactant;
      ii) 2 to 15 wt. % fatty acid;
      iii) 0.4 to 6 wt. % of a salt of a divalent cation;
      iv) 8 to 35 wt. % solvent;
      v) 0.5 to 4 wt. % of a salt of a monovalent metal cation; and
      vi) 0.3 to 5 wt. % of a co-surfactant that differs from the non-ionic surfactant and is selected from the group consisting of, aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, and monoglycerol ethers of $C_8$-$C_{18}$ fatty alcohols;
   d) further transporting the filled cavity in the direction of a sealing station at a speed above 0.04 m/s;
   e) sealing the filled cavity with a second water-soluble film;

wherein the first flowable washing agent preparation has a turbidity above 60 NTU and is free from enzymes.

2. The method according to claim 1, wherein the water-soluble film is continuously transported from step a) to step e).

3. The method according to claim 1, wherein the first water-soluble film is transported at a speed from 0.08 to 0.3 m/s in step a).

4. The method according to claim 3, wherein the first water-soluble film is transported at a speed from 0.1 to 0.2 m/s.

5. The method according to claim 1, wherein the cavity formed in step b) has a maximum diameter in the direction of travel of the film between 3 and 40 mm.

6. The method according to claim 5, wherein the cavity has a maximum diameter in the direction of travel of the film between 3 and 20 mm.

7. The method according to claim 5, wherein the cavity has a maximum diameter in the direction of travel of the film between 3 and 15 mm.

8. The method according to claim 1, wherein the first flowable washing agent preparation contains, based on its total weight,
   i) 20 to 80 wt. % surfactant, wherein the anionic surfactant is present in an amount from 20 to 50 wt. %;
   ii) 4 to 12 wt. % of the fatty acid;
   iii) 0.5 to 4 wt. % of the salt of a divalent metal cation.

9. The method according to claim 1, wherein the first flowable washing agent preparation contains, based on its total weight,
   i) 32.3 to 80 wt. % of the surfactant, wherein the anionic surfactant is present in an amount from 20 to 50 wt. % and the nonionic surfactant is present in an amount from 12 to 30 wt. %;
   ii) 4 to 12 wt. % of the fatty acid;
   iii) 0.5 to 4 wt. % of the salt of a divalent cation.

10. The method according to claim 1, wherein the first water-soluble film is transported at a speed from 0.08 to 0.3 m/s in step d).

11. The method according to claim 10, wherein the first water-soluble film is transported at a speed from 0.1 to 0.2 m/s.

12. The method according to claim 1, wherein the washing agent portion unit has at least two receiving chambers which enclose one another at least in part.

13. The method according to claim 1, wherein the first water-soluble film is transported in the direction of a dosing station at a speed of 0.08 m/s.

14. The method according to claim 1, wherein the filled cavity is further transported in the direction of a sealing station at a speed of 0.08 m/s.

15. A method for producing a washing agent portion unit having at least one filled receiving chamber surrounded by a water-soluble film, comprising the steps of:

a) transporting a first water-soluble film in the direction of a dosing station at a speed above 0.04 m/s;

b) molding the first water-soluble film into cavities of a deep-drawing die located below the water-soluble film, so as to form at least one cavity having a maximum diameter in the direction of travel of the film of between 3 and 75 mm;

c) filling the cavity by means of the dosing station with a first opacified flowable washing agent preparation free of amphoteric surfactant and containing, based on its total weight, i) 20 to 80 wt. % surfactant containing anionic surfactant and non-ionic surfactant, ii) 2 to 15 wt. % fatty acid;

iii) 0.5 to 4 wt. % of the salt of a divalent cation;

iv) 8 to 35 wt. % solvent;

v) 0.5 to 4 wt. % of a salt of a monovalent metal cation; and vi) 0.3 to 5 wt. % of a co-surfactant that differs from the non-ionic surfactant and is selected from the group consisting of aliphatic $C_6$-$C_{14}$ alcohols, aromatic $C_6$-$C_{14}$ alcohols, aliphatic $C_6$-$C_{12}$ dialcohols, monoglycerides of $C_{12}$-$C_{18}$ fatty acids, and monoglycerol ethers of $C_8$-$C_{18}$ fatty alcohols;

d) further transporting the filled cavity in the direction of a sealing station at a speed above 0.04 m/s; and e) sealing the filled cavity with a second water-soluble film.

16. The method according to claim 15, wherein the water-soluble film is continuously transported from step a) to step e).

17. The method according to claim 15, wherein the first water-soluble film is transported at a speed from 0.08 to 0.3 m/s in steps a) and d).

* * * * *